US006596950B2

(12) United States Patent
Danek

(10) Patent No.: US 6,596,950 B2
(45) Date of Patent: Jul. 22, 2003

(54) ROTARY SWITCH

(75) Inventor: Daniel J. Danek, Berwyn, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/236,112

(22) Filed: Sep. 6, 2002

(65) Prior Publication Data

US 2003/0047432 A1 Mar. 13, 2003

Related U.S. Application Data

(60) Provisional application No. 60/318,535, filed on Sep. 10, 2001.

(51) Int. Cl.[7] ..... H01H 19/58

(52) U.S. Cl. ..... 200/11 R; 200/568

(58) Field of Search ..... 200/11 A, 564, 200/11 R, 568, 573, 570, 571, 336

(56) References Cited

U.S. PATENT DOCUMENTS

| | | | | |
|---|---|---|---|---|
| 3,596,013 A | | 7/1971 | Pihl | |
| 3,632,911 A | | 1/1972 | Endou | |
| 3,754,106 A | | 8/1973 | MacDonald | |
| 3,770,926 A | * | 11/1973 | Wanner | 200/325 |
| 3,781,499 A | * | 12/1973 | Reichert et al. | 200/565 |
| 3,912,886 A | | 10/1975 | Allen et al. | |
| 3,959,614 A | | 5/1976 | Graninger | |
| 3,965,755 A | | 6/1976 | Rosenberg et al. | |
| 4,107,482 A | * | 8/1978 | Marker | 200/6 B |
| 4,154,991 A | | 5/1979 | Hickman et al. | |
| 4,166,200 A | | 8/1979 | Reichen et al. | |
| 4,334,132 A | | 6/1982 | Poole | |
| 4,348,569 A | | 9/1982 | Golbeck et al. | |
| 4,419,546 A | | 12/1983 | Arthur | |
| 4,473,726 A | | 9/1984 | Hung | |
| 4,490,588 A | | 12/1984 | Guenther et al. | |
| 4,739,138 A | | 4/1988 | Wolf | |
| 4,837,413 A | | 6/1989 | Schwab et al. | |
| 5,161,422 A | | 11/1992 | Suman et al. | |
| 5,278,364 A | | 1/1994 | Misawa et al. | |
| 5,315,077 A | * | 5/1994 | Simon et al. | 200/11 R |
| 5,438,172 A | * | 8/1995 | Fowler et al. | 200/11 R |
| 5,641,952 A | | 6/1997 | Collings | |

* cited by examiner

*Primary Examiner*—Lincoln Donovan
*Assistant Examiner*—Lisa Klaus
(74) *Attorney, Agent, or Firm*—Mark W. Croll; Paul F. Donovan

(57) ABSTRACT

A rotary switch suitable for use as a transmission gear selection switch. The switch includes a housing and a rotor rotationally connected to the housing, the rotor being rotational about a first axis. A cam follower connected to the rotor has a cam surface substantially centered about a radial axis, the radial axis being normal to the first axis. An electrical contact carried by the rotor has a contact surface spaced from the cam surface along the radial axis.

20 Claims, 2 Drawing Sheets

ROTARY SWITCH

CROSS REFERENCE TO RELATED APPLICATIONS

This application claims the benefit of U.S. Provisional Application No. 60/318,535, filed Sep. 10, 2001.

FIELD OF THE INVENTION

The present invention relates to an electrical switch, and, more particularly, to a cam follower mechanism for a rotary switch as found in a transmission selection rotary switch of a vehicle.

BACKGROUND OF THE INVENTION

Electrical switches are well known. One common type of electrical switch is a rotary switch having a rotating shaft connected to a terminal capable of making or breaking an electrical connection with one or more other terminals. Rotary switches may convert positions into binary numbers; such switches are known as coded switches. For example, a three terminal coded switch can output a binary code equivalent to eight positions. The three terminals electrically reflecting the binary equivalent of the eight switch positions.

Rotary switches contain contacts which may be non-shorting contacts, otherwise known as break-before-make contacts, which operate by breaking a preceding circuit before closing the next circuit. Converse to that, rotary switches may also have shorting contacts, which operate as make-before-break contacts. The make-before-break feature indicates that an electrical contact is made with the next position before breaking the electrical contact with the current position.

Rotary switches are also known which have three ball bearings therein to provide a rotational and a detent feature within the rotary switch. Rotary switches are known to have moveable electrical contacts therein, which slide from one electrical contact on a printed circuit board or substrate to another electrical contact on the printed circuit board or substrate. The wiping action of a movable contact relative to a stationary contact within the rotary switch allows the rotary switch to connect electrical circuits subject to the rotational position of the shaft.

A problem with rotary switches is that the wiping of the movable contact from one stationary contact to another stationary contact causes a migration of conductive material across a nonconductive separating material, thereby causing intermittent or shorted conditions among the stationary contacts.

What is needed in the art is a break-before-make rotary switch, which doesn't short between contacts.

SUMMARY OF THE INVENTION

The present invention provides an apparatus for breaking electrical contact on both a common and signal surface before making electrical contact with a second signal surface.

The invention comprises, in one form thereof, a rotary switch including a housing and a rotor rotationally connected to the housing. The rotor is rotatable about a first axis. A cam follower is connected to the rotor, and has a cam surface substantially centered about a radial axis. The radial axis is normal to the first axis. An electrical contact has a contact surface spaced from the cam surface along the radial axis.

The invention comprises, in another form thereof, a method of passing a signal to a common terminal. The method includes steps of providing a rotary switch having a plurality of conductors and an electrical contact connected to a cam follower, the cam follower being connected to a rotor rotatable about a first axis, and biased toward at least one of the conductors with a biasing device in a direction substantially parallel to the first axis, the electrical contact being electrically connectable with at least one of the plurality of conductors; placing an electrical signal on at least one of the plurality of conductors; and connecting the electrical signal through the electrical contact to the common terminal.

The invention comprises, in yet another form thereof, a transmission gear selection switch including a housing and a rotor at least partially disposed in the housing. The rotor is rotatable about a first axis. A cam follower is connected to the rotor and is movable along a second axis, the second axis being parallel to the first axis. The cam follower is disposed to follow a path in the housing. At least one ridge is positioned along the path, oriented along a corresponding radial axis, the radial axis being normal to the first axis.

An advantage of the present invention is that the rotary switch breaks both a common and a signal contact by movement of a single cam follower.

Another advantage of the present invention is that a three contact conductor connects a common terminal to a signal terminal, the three contact connections providing mechanical stability to the conductor in the rotary switch.

Yet another advantage is that the contact is held in electrical contact with contact sectors with a spring, thereby compensating for contact wear.

Yet still another advantage is that the conductive material from one sector does not migrate to another sector since the contact is lifted from one sector and placed onto an adjacent sector.

Other features and advantages of the invention will become apparent to those skilled in the art upon review of the following detailed description, claims and drawings in which like numerals are used to designate like features.

BRIEF DESCRIPTION OF THE DRAWINGS

The above-mentioned and other features and advantages of this invention, and the manner of attaining them, will become more apparent, and the invention will be better understood by reference to the following description of an embodiment of the invention, taken in conjunction with the accompanying drawings, wherein.

Figure 1:
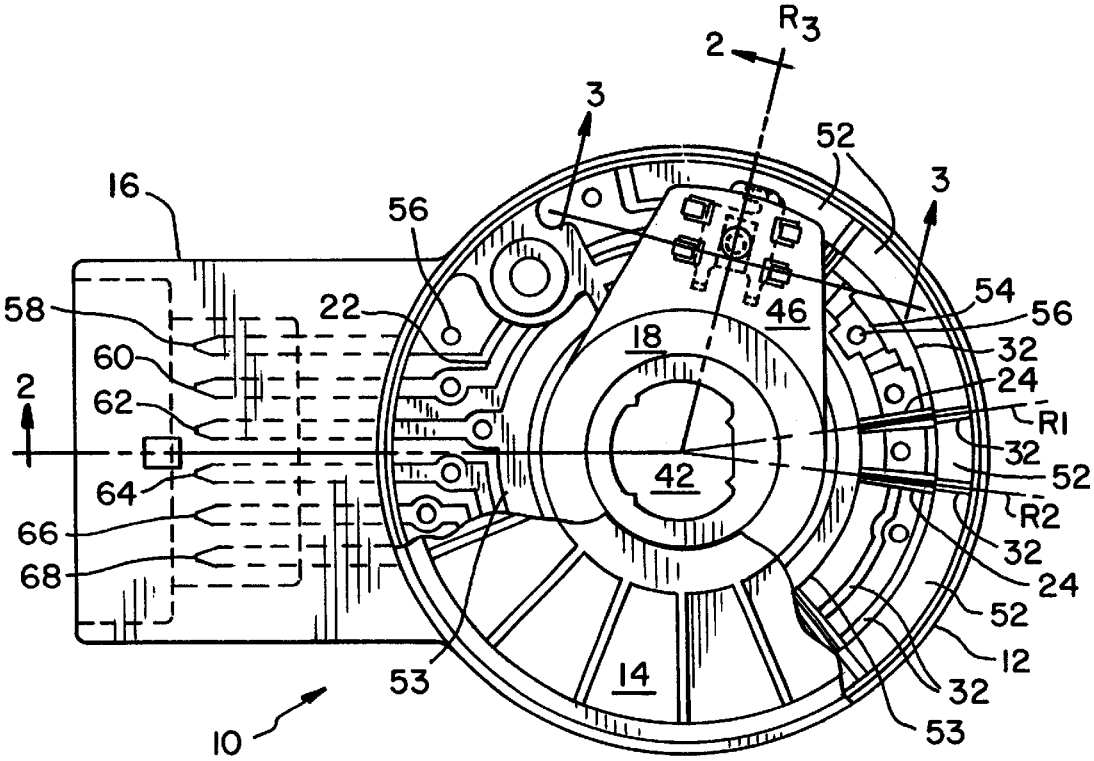
FIG. 1 is a partially sectioned top view of an embodiment of a rotary switch of the present invention.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use of "including" and "comprising" and variations thereof herein is meant to encompass the items listed thereafter and equivalents thereof as well as additional items and equivalents thereof.

DETAILED DESCRIPTION OF THE PREFERRED EMBODIMENT

Figure 2:
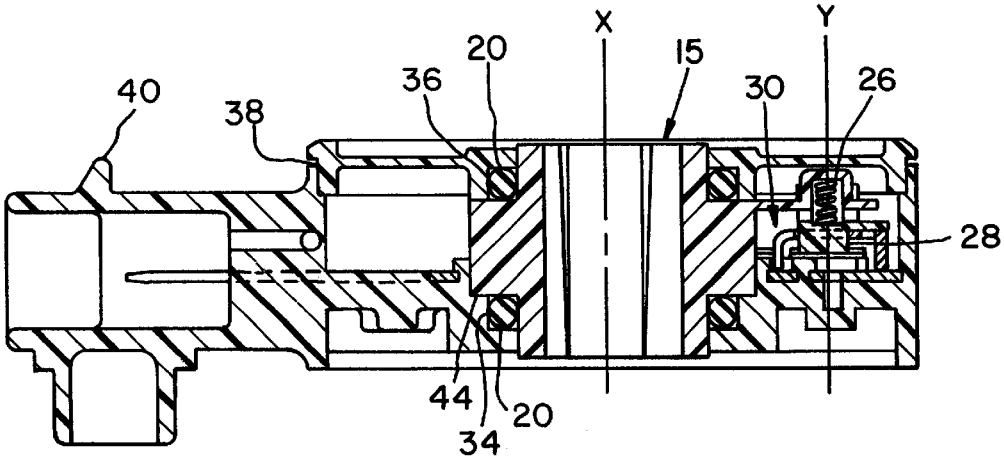
FIG. 2 is a partially sectioned side view along section line 2—2 of the rotary switch of FIG. 1.

Referring now to the drawings, and more particularly to FIGS. 1 and 2, there is shown a rotary switch 10 in accordance with the present invention. The exemplary embodiment of switch 10 is a transmission gear selection switch 10 including a housing 12, a cover 14, a connector 16, a rotor 18, O-rings 20, conductors 22, cam interface ridges 24, a biasing device such as coil spring 26, a cam follower 28 and a contact 30.

Housing 12 includes separators 32 and O-ring retaining surface 34. Housing 12 is integral with connector 16 both being formed from a non-conductive plastic by way of an injection molding process. Housing 12 interfaces with cover 14 to provide an environmental seal for the inner workings of rotary switch 10. O-rings 20 provide a water and dust seal by way of the compression of cover 14 with rotor 18 and housing 12. Conductors 22 are molded into the inner body of housing 12, with one side of conductors 22 being exposed for electrical connection with contact 30.

Separators 32 are located between adjacent conductors 22, and prevent electrical contact between adjacent conductors 22. Separators 32 are also positioned along a radial axis such as radial axis R1 or R2. Separators 32 are made of nonconductive material and are integral with housing 12.

O-ring retaining surface 34 is in contact with an O-ring 20 that is compressed by the presence of rotor 18 as it is positioned into housing 12 during assembly of switch 10.

Cover 14 includes O-ring retaining surface 36 and housing interface 38. Cover 14 is made from a material that is compatible with housing 12 and is positioned to environmentally seal housing 12. O-ring retaining surface 36 interfaces with an O-ring 20 that is compressed between O-ring retaining surface 36 and rotor 18. Housing interface 38 interconnects with an edge of housing 12. The contacting surfaces of housing 12 and cover 14 may be sealed using an adhesive or thermal bonding method. Cover 14 has a central opening 15 thereby allowing external access to rotor 18.

Connector 16 includes a retaining protrusion 40 and signal terminals 58–68 located therein. Connector 16 is formed in an integral manner with housing 12. Connector 16 allows for a polarized connection with a corresponding plug (not shown). Retaining protrusion 40 is positioned to prevent the mating of connector 16 with an incorrectly shaped plug. Retaining protrusion 40 also serves to retain a plug (not shown) connected with connector 16.

Rotor 18 includes a D-shaped opening 42, a shoulder 44, a rotor arm 46, a coil spring cavity 48 and cam retainer openings 50. Rotor 18 is rotatable about an axis X within rotary switch 10. A cylindrical portion of rotor 18 interfaces with O-rings 20 to seal contamination out of rotary switch 10. D-shaped opening 42 extends through rotor 18 along axis X, and is shaped to accommodate a D-shaped shaft (not shown). The D-shaped shaft (not shown) is rotated to a desired angular position, thereby causing a rotation of rotor 18. Shoulder 44 may be a series of fluted edges that wipe along the top of O-ring 20 to provide mechanical compression thereagainst, yet allow for tolerances in the manufacture of rotor 18 and assembly tolerances of housing 12 and cover 14.

Rotor arm 46 includes a coil spring cavity 48 and cam retainer openings 50. Rotor arm 46 extends outward from the body of rotor 18 in a manner normal to axis X. On rotor arm 46 there are four cam retainer openings 50 to position and retain cam follower 28. Coil spring cavity 48 is molded into a portion of rotor arm 46 to position and stabilize coil spring 26. Coil spring cavity 48 is positioned to be in alignment with a spring recess 74 of cam follower 28. Cam follower 28 is retained by rotor arm 46 and is moveable along axis Y, which is parallel to axis X. Cam follower 28 is positioned along a side of rotor arm 46 at a fixed radius from axis X. Cam follower 28 follows a path that is based on the location of cam follower 28 on rotor arm 46 and the rotation of rotor 18. The path being normal to, and at a fixed radius from, axis X.

Conductors 22 include contact sectors 52, a common sector 53, interconnection portions 54, positioning holes 56, signal terminals 58, 60, 64, 66 and 68, and a common terminal 62. Signal terminals 58, 60, 64, 66 and 68 include a high terminal 58, a low terminal 60, a neutral terminal 64, a reverse terminal 66 and a park terminal 68. Terminals 58, 60, 64, 66 and 68 are each electrically connected to a corresponding contact sector 52. Contact sectors 52 lie in a plane normal to axis X at a radial distance from axis X. Contact sectors 52 are concentrically located about axis X with each contact sector 52 being a portion of an arc. The ends of adjacent contact sectors 52 are electrically isolated from each other by separators 32. Terminal 62 is connected to common sector 53, which is positioned close to rotor 18 in the same plane as contact sectors 52. Terminals 58, 60, 64, 66 and 68 are electrically connected to corresponding contact sectors 52 by way of interconnection portions 54. Positioning holes 56 are located to assist in the injection molding process for the positioning of conductors 22 in a mold prior to injection molding taking place.

Each contact sector 52 is electrically connected to a corresponding terminal 58, 60, 64, 66 or 68, and sectors 52 are separated, in a radial direction from axis X, by separators 32. Contact sectors 52 are located a radial distance from axis X that is different than the radial distance of cam follower 28 from axis X, which are each different than the radial distance of common sector 53 from axis X. Separators 32 are part of housing 12 and are approximately level with or slightly below the surface of sectors 52.

Terminals 58–68 are used to transmit electrical signals that are representative of the angular position of a manually operated D-shaped shaft (not shown) inserted into rotor 18. The position of rotor arm 46 variously electrically connects at least two of terminals 58–68 to each other. The signal that results from the positioning of rotor arm 46 may then be used to select the gear of an automatic transmission. The position of rotor arm 46, is positioned by a vehicle operator, using a lever (not shown) connected to the D-shaped shaft (not shown), thereby selecting a transmission gear of high, low, neutral, reverse or park. The signal of the selected gear is electrically transmitted to common terminal 62. High terminal 58, low terminal 60, neutral terminal 64, reverse terminal 66 and park terminal 68 are so labeled and used relative to the terms for transmission gears in an automatic transmission of a vehicle. The selection of electrical signals and the passing of those signals to a common terminal by way of rotary switch 10 can encompass any electrical signal, not just those associated with an automatic transmission. Rotary switch 10 conveys a signal or conduction path from terminals 58, 60, 64, 66 or 68 to common terminal 62 based upon the position of contact 30, which is determined by the rotational position of rotor 18. The positioning of rotor 18 causes an electrical connection between a sector 52 and common terminal 62 by way of the positioning of contact 30.

Figure 3:
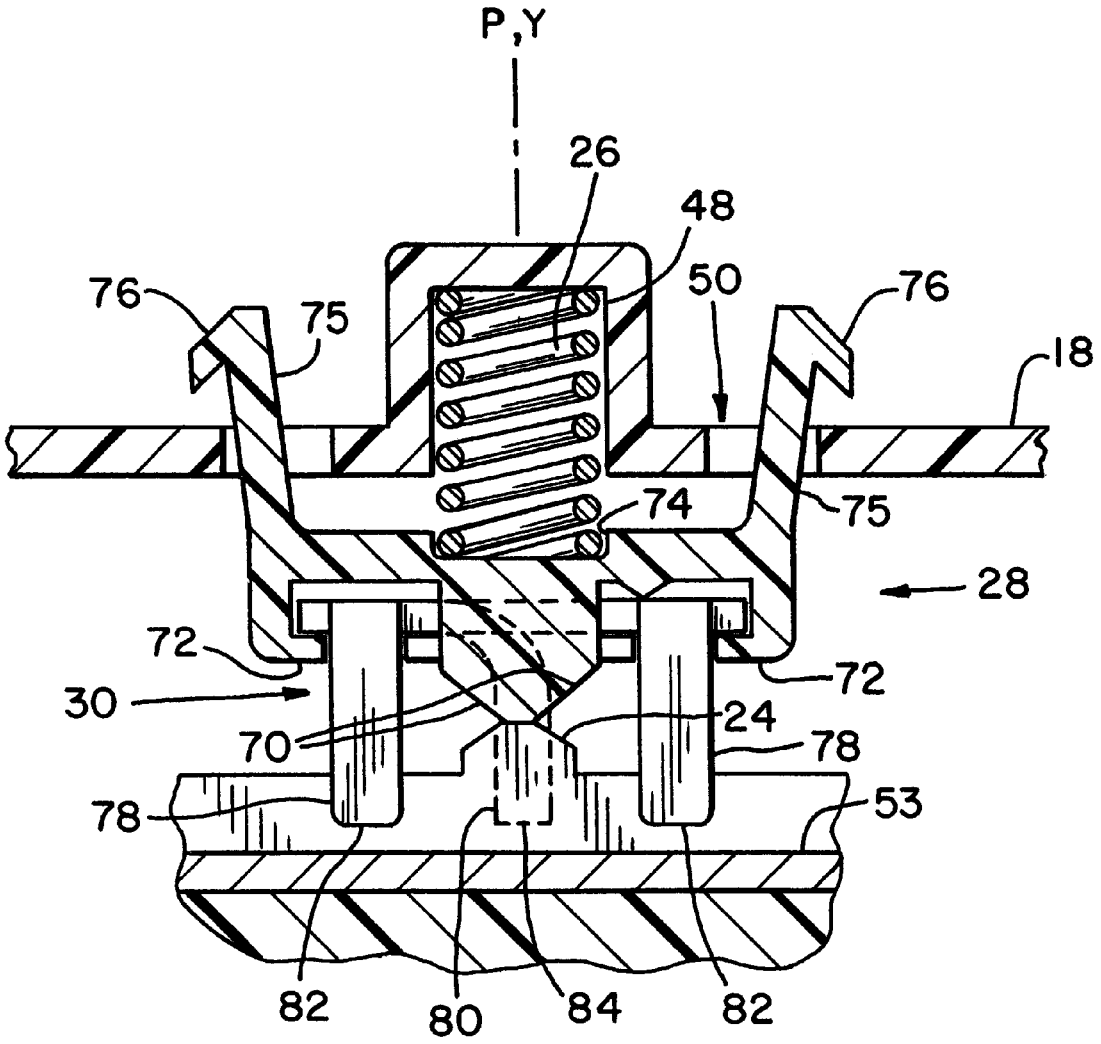
FIG. 3 is an enlarged partially sectioned view along section line 3—3 illustrating a cam follower encountering a ridge of the rotary switch of FIGS. 1 and 2.

Now, additionally referring to FIG. 3, there is shown cam follower 28 retained by rotor 18. Cam follower 28 includes a cam surface 70, contact retaining protrusions 72, a spring recess 74, arms 75 and retaining fingers 76. Cam surface 70 is positioned in rotary switch 10 to encounter ridges 24 as rotor 18 is rotated. Ridges 24 extend in a radial direction from axis X along radial axis R1 or R2 as shown in FIG. 1 or along any other radial axis originating at axis X and normal thereto. Ridges 24 do not extend radially into the area where sectors 52 or common sector 53 are located, and thereby do not cause any interference with the movement of contact 30. Ridges 24 have a ramped surface to co-act with cam surface 70 to lift cam follower 28 and thereby respectively break electrical connection of contacts 78 and 80 with sectors 52 and 53. Cam surface 70 is centered about a radial axis R3, which is normal to axis X and axis Y.

Contact 30 includes common sector contacts 78 and signal contact 80. Common sector contacts 78 each have a contact surface 82 that is directed toward common sector 53. Contact surfaces 82 come into sliding electrical contact with common sector 53 when cam surface 70 is not in contact with a ridge 24. Signal contact 80 has a contact surface 84 that is directed to a contact sector 52. Contact surface 84 comes into sliding electrical contact with a contact sector 52 when cam surface 70 is not in contact with a ridge 24. Contact surface 84 is centered about contact plane P.

Contact retaining protrusions 72 extend from the body of cam follower 28 to hold contact 30 such that contact 30 will move with cam follower 28. Cam follower 28 is biased by spring 26 to hold contacts 78 and 80 in electrical connection with corresponding sectors 53, 52, that is except for when cam surface 70 encounters ridge 24. While coil spring 26 is shown as a biasing device, it should be understood that other structures including springs or other biasing devices can be used for biasing contacts 78 and 80 toward corresponding sectors 53, 52.

Arms 75 extend from the body of cam follower 28 through cam retainer openings 50 and are free to slide, thereby allowing cam follower 28 to move along the Y-axis. Retaining fingers 76 are located at an end of each respective arm 75, thereby retaining cam follower 28 to rotor 18 and preventing spring 26 from fully extending. Spring recess 74 co-acts with coil spring cavity 48 to hold coil spring 26 in position to properly bias cam follower 28.

Signal contact 80 is centered around contact plane P as shown in FIG. 3. Axis X, axis Y, and radial axis R3 are coplanar with contact plane P. Cam surface 70 is also centered along contact plane P such that as cam follower 28 transitions across ridge 24, cam follower 28 is displaced along axis Y, causing contact 80 to lift from contact sector 52 proximate to the location of separator 32, thereby breaking the electrical connection between signal contact 80 and contact sector 52. Also as a result of cam follower 28 being displaced along axis Y, the electrical connection between common sector contacts 78 and common sector 53 is broken. The co-acting of two common sector contacts 78 along with signal contact 80 and coil spring 26 bring stability to contact 30 particularly as it slides along sectors 52 and 53. The stability is the result of there being three physical points of contact with sectors 52 and 53.

Rotary switch 10 is mounted to an assembly and is electrically connected to a transmission control system. A D-shaped shaft (not shown) is placed into D-shaped opening 42 of rotor 18 and connected with a user operable lever. As the user operable lever is moved, rotor 18 correspondingly moves, to/from high, low, neutral, reverse and park designations. The positioning of the lever (not shown) corresponds with the electrical connections of contact sectors 52, which establish an electrical connection to common terminal 62, thereby providing a signal on common terminal 62 that corresponds to the physical positioning of the lever (not shown). The positioning of rotor 18 can correspond to other physical phenomenon associated with a rotational position. More or fewer contact sectors may be utilized to provide signals or grounding type control systems by way of terminals located in rotary switch 10. In addition rotary switch 10 may be ganged in multiple layers to provide additional positional information to an automotive or other system.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A rotary switch, comprising:

a housing;

a rotor rotationally connected to said housing, said rotor rotatable about a first axis;

a cam follower connected to said rotor, said cam follower having a cam surface substantially centered about a radial axis, said radial axis normal to said first axis; and an electrical contact carried by said cam follower, said electrical contact having a contact surface spaced from said cam surface along said radial axis.

2. The switch of claim 1, wherein said rotor includes a rotor arm, said cam follower being attached to said rotor arm, said cam follower being biased in a direction normal to said rotor arm.

3. The switch of claim 2, further comprising a plurality of contact sectors, at least one of said contact sectors being in breakable electrical connection with said contact surface of said electrical contact.

4. The switch of claim 3, wherein said contact sectors are substantially disposed in a plane.

5. The switch of claim 3, wherein said plurality of contact sectors include a first contact sector and a second contact sector, both said first contact sector and said second contact sector having a first end, said first end of said first contact sector and said first end of said second contact sector disposed proximate each other along an other radial axis.

6. The switch of claim 5, further comprising at least one ridge including a first ridge disposed along said other radial axis, said ridge positioned apart from said first end of said first contact sector and said first end of said second contact sector.

7. The switch of claim 6, wherein said cam follower is configured to encounter said first ridge thereby breaking an electrical connection between said electrical contact and at least one of said plurality of contact sectors.

8. The switch of claim 7, further comprising a biasing device operatively disposed between said cam follower and said rotor arm.

9. The switch of claim 8, further comprising a plurality of electrical terminals each being electrically connected to a corresponding one of said plurality of contact sectors.

10. The switch of claim 1, further comprising:

a ridge connected to said housing; and at least one contact sector electrically connectable to said electrical contact, said cam surface co-acting with said ridge to reposition said cam follower thereby electrically disconnecting said electrical contact from at least one said contact sector.

11. A method of passing a signal to a common terminal, comprising the steps of:

providing a rotary switch having a plurality of conductors and an electrical contact connected to a cam follower, said cam follower being connected to a rotor rotatable about a first axis, said cam follower biased toward at least one of said plurality of conductors with a biasing device in a direction substantially parallel to said first axis, said electrical contact electrically connectable with at least one of said plurality of conductors;

placing an electrical signal on at least one of said plurality of conductors of said rotary switch; and connecting said electrical signal through said electrical contact to the common terminal.

12. The method of claim 11, further comprising steps of providing a ridge in said switch, rotating said rotor such that said cam follower encounters said ridge, and terminating an electrical connection of said electrical signal with the common terminal when said cam follower encounters said ridge.

13. The method of claim 12, wherein said terminating step further comprises the sub-step of moving said cam follower against said biasing device and away from said plurality of conductors when said cam follower encounters said ridge.

14. A transmission gear selection switch, comprising:

a housing;

a rotor at least partially disposed in said housing, said rotor rotatable about a first axis;

a cam follower connected to said rotor, said cam follower movable along a second axis, said second axis being parallel to said first axis, said cam follower disposed to follow a path in said housing as said rotor is rotated; and at least one ridge positioned along said path, said at least one ridge oriented along a corresponding radial axis, said radial axis normal to said first axis.

15. The switch of claim 14, further comprising an electrical contact carried by said rotor, said electrical contact having a contacting surface substantially centered about a plane, said plane including said first axis and said second axis.

16. The switch of claim 15, wherein said contact is movable in a direction substantially parallel with said second axis.

17. The switch of claim 15, further comprising a plurality of contact sectors connected to said housing, said plurality of contact sectors being concentrically located along a portion of an arc around said first axis at a first radius.

18. The switch of claim 17, further comprising a common contact sector being concentrically located with said plurality of contact sectors at a second radius from said first axis, said electrical contact having an other contacting surface in electrical connection with said common contact sector.

19. The switch of claim 18, wherein said path is substantially circular and normal to said first axis and said second axis.

20. The switch of claim 19, wherein said at least one ridge includes a first ridge located at a distance from said first axis greater than said second radius and less than said first radius.

* * * * *